United States Patent [19]

Stant

[11] 4,392,518

[45] Jul. 12, 1983

[54] FENCE WIRE WINDER

[76] Inventor: Ivan H. Stant, 2003 Indiana Ave., Connersville, Ind. 47331

[21] Appl. No.: 264,120

[22] Filed: May 15, 1981

[51] Int. Cl.[3] ..... B21F 7/00

[52] U.S. Cl. ..... 140/119; 140/122; 74/577 S; 192/46

[58] Field of Search ..... 140/117, 118, 119, 120, 140/121, 122, 123; 72/458, 459; 81/60, 61; 74/577 R, 577 S, 577 SF, 577 M, 111, 575; 192/46

[56] References Cited

U.S. PATENT DOCUMENTS

| | | | |
|---|---|---|---|
| D. 238,140 | 12/1975 | Guimarin | D8/25 |
| 756,148 | 3/1904 | Simpson | 140/122 |
| 1,075,333 | 10/1913 | Clark | 140/122 |

*Primary Examiner*—Francis S. Husar
*Assistant Examiner*—Linda McLaughlin
*Attorney, Agent, or Firm*—Woodward, Weikart, Emhardt & Naughton

[57] ABSTRACT

A fence wire winder for twisting together two strands of wire includes a single-piece handle member with a clearance aperture disposed in one end and a generally cylindrical spindle member extending through this clearance aperture. Secured to this spindle member is a knurled ratchet wheel and secured to the handle member is an engaging, spring-loaded pawl. The action of the pawl relative to the knurled ratchet wheel permits the handle member to be locked to the spindle member so that the two members turn together in a first direction of rotation while in the reverse direction of rotation, the handle member freely moves relative to the spindle member which remains stationary. The spindle member is retained in position by the knurled ratchet wheel on one side and a washer and retaining thimble arrangement on the opposite side. Disposed within the spindle member and extending therethrough is a longitudinal clearance channel for receipt of a first strand of wire. Transverse to this longitudinal clearance channel are two wire-receiving channels for receipt of the second strand of wire which is to be twisted or wound around the first strand. The first strand of wire is disposed substantially coincident with the axis of rotation of the handle member so that it remains stationary, regardless of the direction of rotation. However, the other strand of wire turns with the spindle and such turning wraps this other strand of wire around the first strand.

4 Claims, 6 Drawing Figures

FENCE WIRE WINDER

BACKGROUND OF THE INVENTION

The present invention relates in general to hand tools for twisting and manipulating wire. In particular, the present invention relates to a wire-winding device for use in twisting together two strands of fence wire.

When wire fencing is present, such as on a farm or ranch, it frequently becomes necessary to erect new rows or sections of fencing or to repair existing fence sections. In certain instances, the fencing can be secured to a post or rail and such securing can be achieved by the use of tacks, nails or staples. In other instances, one section of fencing may need to be secured to another section of fencing or a single section may need to be repaired. In these instances, when a post or rail is not present, means are needed in order to twist together two strands of wire in order to establish a strong joint. While the two strands may be mutually twisted together, one relative to the other, an equally acceptable technique is to coil one strand about the other strand which remains relatively stationary. The most commonly employed hand tool for wire twisting generally is a pair of pliers; but their gripping and securing capabilities are limited and the resulting joint is often uncertain and unreliable. Further, the use of a pair of pliers for wire twisting is quite awkward and time consuming.

One improvement to the use of pliers has been offered by U.S. Pat. No. 3,297,060 which issued Jan. 10, 1967 to Richardson. The Richardson discloses what is called a "wire splicer," but which is in fact a hand tool for twisting one strand of wire about another strand. This device enables placement of one strand in a longitudinal channel and the other strand in a transverse channel. A ratchet mechanism permits the "other" strand to be wound around the "one" strand while the "one" strand remains stationary within the longitudinal channel.

Unfortunately, the Richardson device is very expensive to manufacture and presents a design complexity far beyond what is necessary in order to accomplish the outlined end-use function. The Richardson device employs a handle which is constructed by riveting together two handle elements separated by a spacer. The internal space between the two handle elements is used to mount a pawl member which acts against ratchet teeth disposed on a cylindrical head which is also positioned between the two handle elements.

It would be an improvement to the Richardson device to construct the handle as a single-piece unit and to configure a ratchet-pawl type of mechanism on one side of the handle, thus reducing the number of parts, device complexity and cost. It is also felt that this improved arrangement would be more reliable and easier to repair due to the fact that all of the component parts would be accessible and easily replaced. The design arrangement disclosed by the present invention provides the improvements and benefits mentioned above as well as others, as will be apparent from the following description.

SUMMARY OF THE INVENTION

A fence wire winder for twisting together two strands of wire according to one embodiment of the present invention comprises a single-piece handle member having two substantially flat opposing surfaces and defining a clearance aperture therethrough adjacent one end of the single-piece handle member, a wire-receiving spindle member extending through the clearance aperture such that a different portion of the spindle member outwardly extends from each of the two substantially flat opposing surfaces of the handle member, the spindle member including a longitudinal wire-receiving channel and a transverse wire-receiving channel adjacent one end of the spindle member, first means for retaining the spindle member within the clearance aperture while permitting rotation of the handle member relative to the spindle member, and second means disposed on one side of the handle member for locking the handle member to the spindle member when the handle member is turned in a first direction of rotation and for permitting free turning of the handle member relative to the spindle member when the handle member is turned in a second direction of rotation which is opposite to the first direction of rotation.

One object of the present invention is to provide an improved fence wire winder for twisting together two strands of wire.

Related objects and advantages of the present invention will be apparent from the following description.

DESCRIPTION OF THE PREFERRED EMBODIMENT

Figure 1:
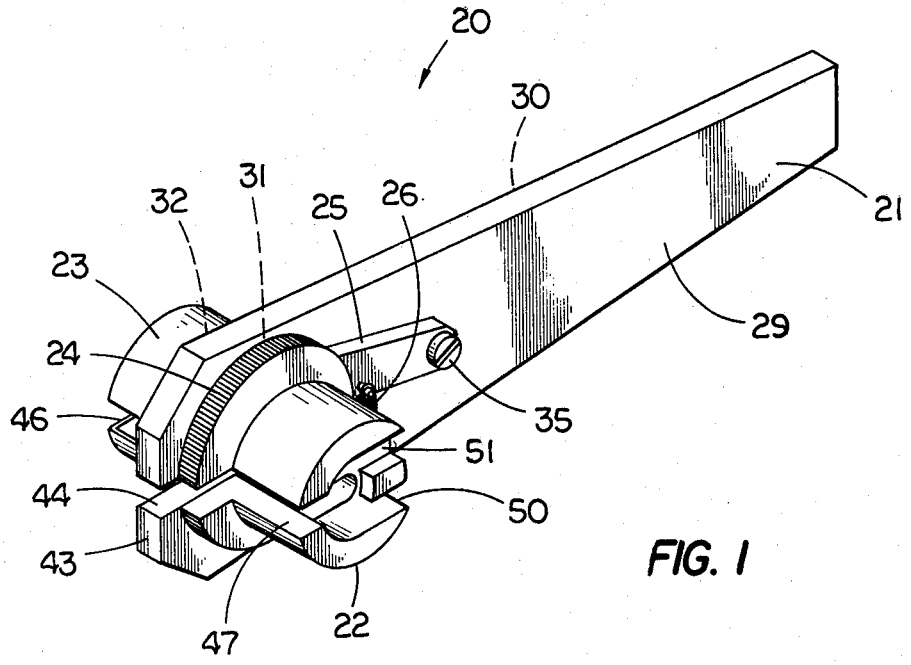
FIG. 1 is a perspective view of a fence wire winder according to a typical embodiment of the present invention.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Referring to FIG. 1, there is illustrated a fence wire winder 20 which is arranged for twisting together two strands of wire as may be involved in adding fence sections or repairing wire fencing. Fence wire winder 20 includes a single-piece handle member 21, a generally cylindrical spindle member 22, a generally cylindrical thimble 23, a knurled ratchet wheel 24, an engaging pawl 25 and a return spring 26.

Figure 2:
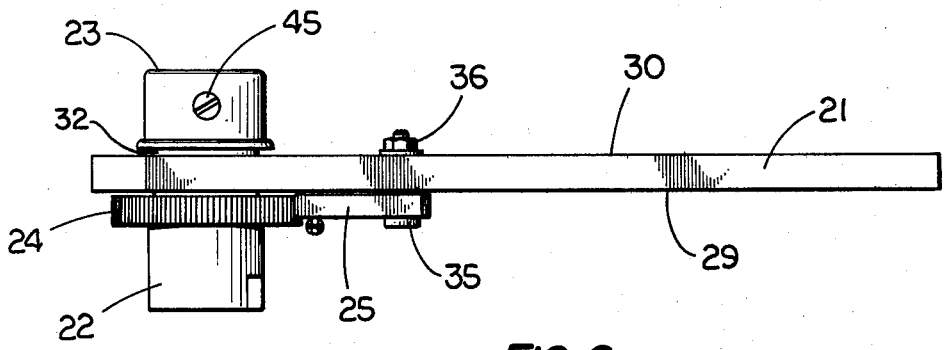
FIG. 2 is a side elevation view of the FIG. 1 fence wire winder.
Figure 3:
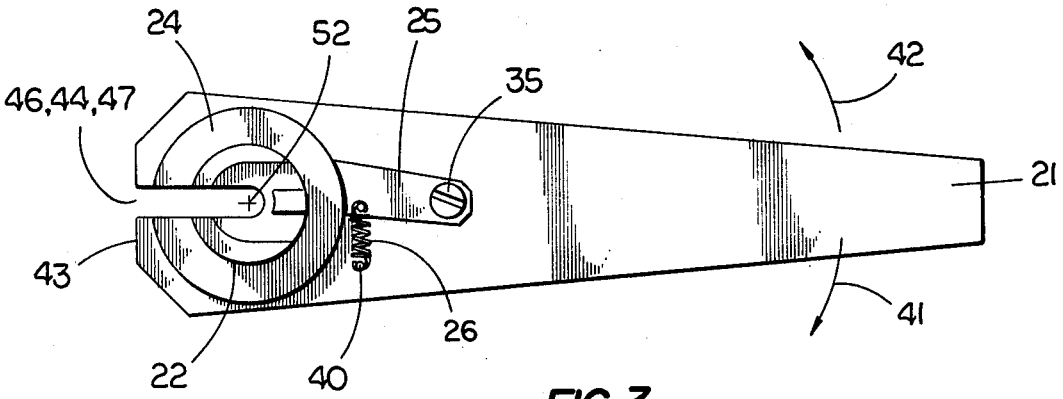
FIG. 3 is a front elevation view of the FIG. 1 fence wire winder.
Figure 5:
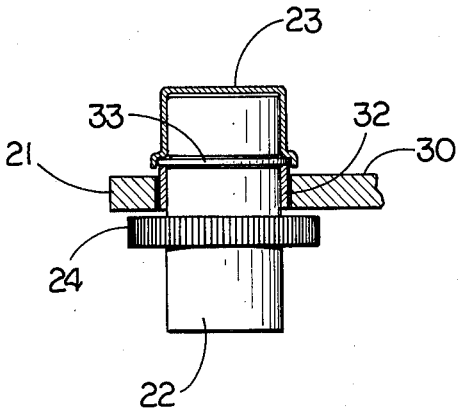
FIG. 5 is a partial side elevation view in full section of the FIG. 1 fence wire winder.
Figure 6:
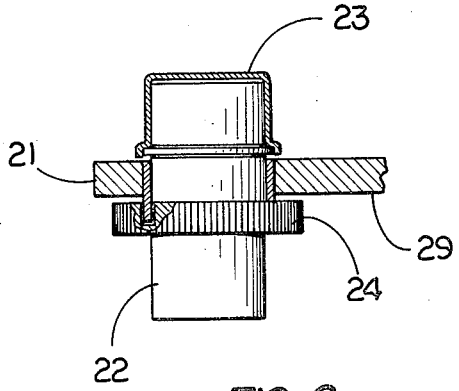
FIG. 6 is a partial side elevation view in full section of an alternative configuration of the FIG. 1 fence wire winder.

Handle member 21 includes two substantially flat and opposing surfaces 29 and 30, and these surfaces in combination with the handle member define a clearance aperture 31 which is adjacent the larger end of the handle member. Disposed within this clearance aperture is a cylindrical bushing 32 which although hidden from view in FIG. 1 is fully illustrated in FIGS. 2 and 4. This bushing is designed and arranged to fit snugly within the clearance aperture and although a moderate level press fit is acceptable, slight welding in order to rigidly secure the bushing to the handle is believed to be preferred. Bushing 32 is flush with one surface of handle member 21 and outwardly extends from the opposite surface in a direction which is substantially perpendicular to the plane of that surface. The FIG. 5 section illustration discloses this bushing as outwardly extending from surface 30 and this is in fact the arrangement which agrees with FIGS. 1–4. In FIG. 6, an alternative arrangement is illustrated wherein the bushing outwardly extends from surface 29. In this particular arrangement, the knurled ratchet wheel must be configured with an annular channel so that the outwardly extending portion of the bushing can be received by the channel thereby allowing the ratchet wheel to be disposed in close proximity to surface 29 for engagement with pawl 25.

One purpose of cylindrical bushing 32 is to provide a greater bearing surface area for spindle member 22. It is to be understood that spindle member 22 extends through bushing 32 in a manner such that a different portion of spindle member 22 outwardly extends from each surface of handle member 21. Lateral movement of spindle member 22 relative to handle 21 is controlled in one direction by the abutment of knurled ratchet wheel 24 up against surface 29. On the opposite side, a flat washer 33 fits around annular groove 34 in the spindle member in order to prevent lateral movement in the opposite direction by abutment of the flat washer against the outwardly protruding end of bushing 32. Although the abutment of ratchet wheel 24 against surface 29 and of flat washer 33 against bushing 32 prevents lateral movement, it is to be understood that these various surfaces do not abut one another and in fact a very slight region of clearance is left so that handle member 21 may be freely rotated about spindle member 22 in either a clockwise or counterclockwise direction.

In accordance with the teachings of this invention, rotational movement of the handle member relative to the spindle is desired in only one direction. Therefore, in order to lock the spindle member to the handle member in a first direction of rotation, engaging pawl 25 is mounted to handle member 21 by screw 35 and nut 36. Extending from the bottom edge of pawl 25 is a retaining spring 39 which is secured to post 40. As should be appreciated, in view of the knurled outside diameter surface of ratchet wheel 24 and engagement by the tip and edge contour of pawl 25 against ratchet wheel 24, handle member 21 is able to turn freely relative to spindle member 22 only in the clockwise direction of arrow 41 (see FIG. 3). When handle 21 is turned in the counterclockwise direction of arrow 42, pawl 25 locks against the knurled outside diameter surface of ratchet wheel 24 causing the handle and the spindle member to turn together.

Connecting clearance aperture 31 with end 43 of handle member 21 is a generally rectangular opening 44. Similar openings or channels are found in the spindle member as well as in the cylindrical thimble 23 which is anchored to the spindle member by set screw 45. Thimble 23 is generally cylindrical and hollow and includes an enlarged flange portion at one end which is suitably sized and arranged to fit over washer 33. The use of thimble 23 assures proper control and spacing of the lateral position of spindle member 22 relative to handle member 21. Rectangular opening 46 in cylindrical thimble 23 coincides with opening 44 and coincides with opening 47 in the spindle member. This arrangement in series of opening 46, opening 44 and opening 47 defines a generally longitudinal clearance channel extending from one end of the spindle member through to the far end of the cylindrical thimble. The aligned and open nature of these three openings is best illustrated in the FIG. 3 front elevation view.

Disposed in one end of spindle member 22 are two channels 50 and 51 which extend completely across the end face of the spindle and are oriented in a direction which is substantially transverse to the longitudinal clearance channel created by openings 46, 44 and 47. Transverse channels 50 and 51 extend from opening 47 to the opposite side of the spindle member. As should be appreciated, the two strands of fence wire to be twisted or wrapped together are to be placed one within the clearance channel defined by the three openings, and the other to be disposed within either transverse channel 50 or transverse channel 51. Since the longitudinal clearance channel defined by openings 46, 44 and 47 extends inwardly to the axis or geometric center of spindle member 22, the longitudinal axis of rotation of the handle member about the spindle member, located at point 52, creates a condition wherein the strand of wire disposed within this longitudinal clearance channel remains stationary, regardless of the direction of movement (rotation) of the handle member and spindle member.

Consequently, by the action of pawl 25, when the spindle member is turned by the action of the handle member, the strand of wire located within either transverse channel 50 or transverse channel 51 is wound about the other strand of wire disposed within the longitudinal clearance channel and which remains stationary throughout this winding or twisting operation. Either direction of strand twisting is possible by merely reversing the direction of the apparatus relative to the two strands of wire. With the orientation provided in the set of figures and with the direction of rotation established by arrows 41 and 42, the strand of wire disposed within either transverse channel 50 or 51 is wound around the stationary strand of wire in a counterclockwise direction. However, by reversing the left-to-right orientation of the fence wire winder, this strand will be wound in a clockwise direction about the stationary strand.

Figure 4:
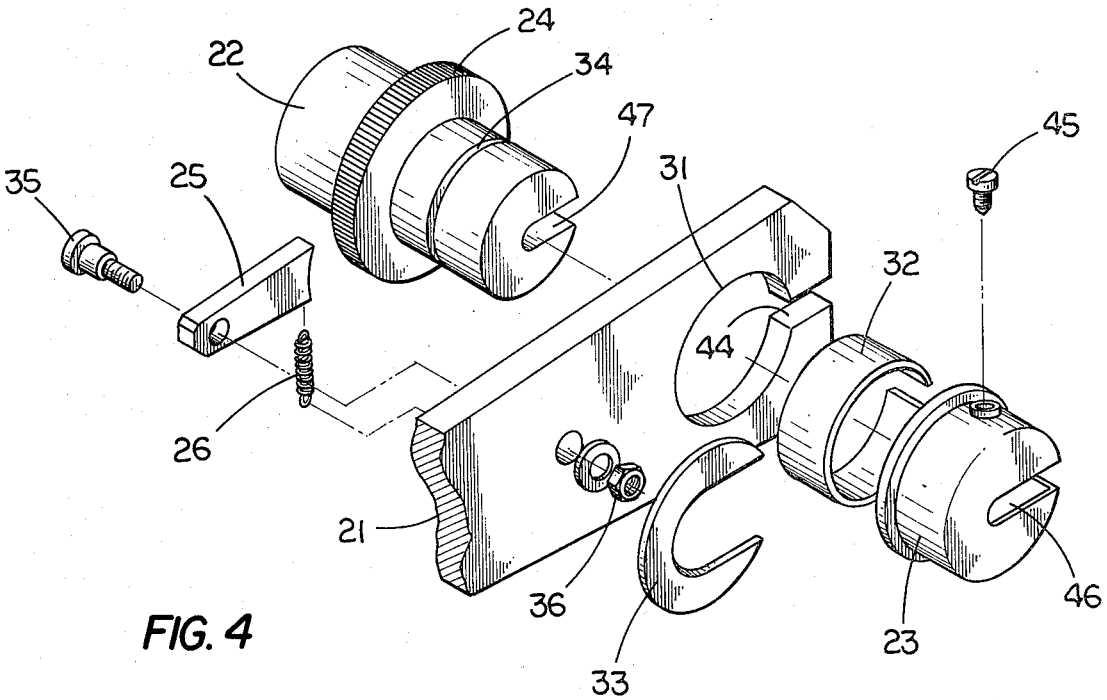
FIG. 4 is a partial exploded view of the FIG. 1 fence wire winder oriented opposite to that of the FIG. 1 drawing.

As should be appreciated by the exploded view illustration of FIG. 4, each of the various component piece parts which comprise fence wire winder 20 are relatively basic in construction and are easily replaced if they become damaged or worn. The entire device may be quickly disassembled with the exception of bushing 32 if it is in fact welded into handle member 21. If cylindrical bushing 32 is receivec by handle member 21 by only a snug press fit, then it may also be easily removed for purposes of replacing or repair. With respect to knurled ratchet wheel 24, this item may be either pressed onto spindle member 22 or may be integral with spindle member 22 as a result of a machining operation wherein the smaller cylindrical portion of spindle member 22 is turned down from the larger stock size representative of the outside diameter size of ratchet wheel 24. The advantages of this fairly basic and easily repaired or replaced construction is that the high cost of component parts and high replacement costs are eliminated. The device in many instances may be repaired by the user without requiring that a new winder be purchased or that the existing winder be returned to the manufacturer for a more elaborate repair operation.

Further, the single-piece handle member represents an improved design in that it does not employ the use of any internal space for the ratchet/pawl operation. Consequently, the ratchet wheel and pawl are placed on the outside of the handle member in full view so that their operation can be watched and easily repaired if the members become worn or shift out of proper alignment with each other. In designs such as that presented by the Richardson patent, with the interior space between two handle halves being employed for the ratchet mechanism, the mechanism is not visible and repair or replacement is extremely difficult, and virtually impossible in view of the fact that the two handle elements are riveted together.

The various component part materials for the present invention are preferably metal or metal alloys, but various grades of plastic are also acceptable. Due to the interface with the strands of wire, it is believed preferred for the spindle to be of metal or metal alloy construction, but some of the remaining components such as bushing 32, handle member 21, washer 33 and thimble 23 could be fabricated of any one of the various durable thermosetting or thermoforming plastic materials.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A fence wire winder for twisting together two strands of wire comprises:

a single-piece handle member having two opposing surfaces and defining a clearance aperture therethrough;

a wire-receiving spindle member extending through said clearance aperture such that a different portion of said spindle member outwardly extends from each of said two opposing surfaces of the handle member, said spindle member defining a circumferential groove and including a longitudinal wire-receiving channel and a transverse wire-receiving channel;

first means for retaining said spindle member within said clearance aperture while permitting rotation of said handle member relative to said spindle member said first means including a flat washer of a "C" configuration having its interior edges cooperatively disposed about said circumferential groove in said spindle and a retaining thimble placed over and secured to the end of said spindle member and extending over said flat washer; and second means disposed on one side of said handle member for locking said handle member to said spindle member when said handle member is turned in a first direction of rotation and for permitting free turning of said handle member relative to said spindle member when said handle member is turned in a second direction of rotation which is opposite to said first direction of rotation.

2. The fence wire winder of claim 1 wherein said second means includes a knurled annular member joined around said spindle member and a spring-biased pawl cooperatively arranged in contact with said knurled annular member.

3. The fence wire winder of claim 1 which further includes a bushing disposed within said clearance aperture and around said spindle member thereby concentrically spacing said spindle member within said clearance aperture.

4. The fence wire winder of claim 4 wherein said knurled annular member, said flat washer, said retaining thimble and said bushing each include a radial slot, said slots being aligned with said longitudinal wire-receiving channel when assembled into said fence wire winder.

* * * * *